US012628973B2

(12) United States Patent
Bergman et al.

(10) Patent No.: US 12,628,973 B2
(45) Date of Patent: May 19, 2026

(54) STRAW ADAPTER WITH SELF-SEALING VALVE FOR WATER BOTTLES

(71) Applicant: The Coleman Company, Inc., Wichita, KS (US)

(72) Inventors: James Bergman, Sugar Grove, IL (US); Scott Kalisz, Seattle, WA (US); Sichong Xia, Chicago, IL (US); Anatoly Kalmanovsky, Buffalo Grove, IL (US); Yuan Zhao Lian, Guangzhou (CN); Arnab Mallik, Palatine, IL (US)

(73) Assignee: The Coleman Company, Inc., Wichita, KS (US)

( * ) Notice: Subject to any disclaimer, the term of this patent is extended or adjusted under 35 U.S.C. 154(b) by 106 days.

(21) Appl. No.: 18/425,495

(22) Filed: Jan. 29, 2024

(65) Prior Publication Data

US 2024/0251977 A1 Aug. 1, 2024

Related U.S. Application Data

(60) Provisional application No. 63/482,224, filed on Jan. 30, 2023.

(51) Int. Cl.

| | |
|---|---|
| ***A47G 19/22*** | (2006.01) |
| ***A45F 3/18*** | (2006.01) |
| ***B65D 23/10*** | (2006.01) |
| ***B65D 47/06*** | (2006.01) |

(52) U.S. Cl.

CPC ..... *A47G 19/2272* (2013.01); *A45F 3/18* (2013.01); *B65D 23/10* (2013.01); *B65D 47/06* (2013.01); *B65D 2547/063* (2013.01)

(58) Field of Classification Search

CPC ... A47G 19/2272; A47G 19/2266; A45F 3/18; B65D 47/06; B65D 47/065; B65D 47/08; B65D 23/10; B65D 2547/063; B65D 2547/066; B65D 2547/06

USPC ..... 220/708, 707, 705, 212.5, 710.5, 752; 215/229, 389, 388

See application file for complete search history.

(56) References Cited

U.S. PATENT DOCUMENTS

| | | | | |
|---|---|---|---|---|
| 5,265,757 | A * | 11/1993 | Wu | A61J 9/006 220/709 |
| 8,186,537 | B2 | 5/2012 | Rosnak et al. | |
| 10,542,833 | B2 | 1/2020 | Davies et al. | |
| 10,683,146 | B2 | 6/2020 | Farsai et al. | |

(Continued)

FOREIGN PATENT DOCUMENTS

| | | | |
|---|---|---|---|
| CN | 112914328 | A | 6/2021 |

*Primary Examiner* — Robert J Hicks
(74) *Attorney, Agent, or Firm* — Husch Blackwell LLP

(57) ABSTRACT

A straw adapter for coupling a straw to a water bottle lid is provided. The straw adapter may receive the straw in a cavity, and a protrusion of the straw adapter may be received by the lid. Retaining rings circumscribing the cavity and the protrusion may provide for frictional coupling. The straw adapter may include a valve comprising a plurality of self-sealing flaps. The self-sealing flaps may be configured to open or close in response to pressure changes. As such, when the self-sealing flaps are oriented vertically, the valve may allow fluid to flow through the straw adapter. Conversely, when the self-sealing flaps are oriented horizontally, the valve may impede fluid from flowing through the straw adapter. Thus, the straw adapter may help to limit unintentional spills.

11 Claims, 8 Drawing Sheets

(56) References Cited

U.S. PATENT DOCUMENTS

| | | | | |
|---|---|---|---|---|
| 10,858,158 | B2 | 12/2020 | Cheng | |
| 10,994,902 | B2 | 5/2021 | Cheng | |
| 2013/0175270 | A1* | 7/2013 | Fujita | B65D 51/1644 220/203.01 |
| 2019/0183269 | A1* | 6/2019 | Kalisz | A47G 19/2266 |
| 2023/0234663 | A1* | 7/2023 | Schaefer | B62K 19/30 |
| 2024/0023739 | A1* | 1/2024 | Bell | B65D 77/32 |

* cited by examiner

STRAW ADAPTER WITH SELF-SEALING VALVE FOR WATER BOTTLES

CROSS-REFERENCE TO RELATED APPLICATIONS

This application claims priority to U.S. Provisional Patent Application Ser. No. 63/482,224, filed on Jan. 30, 2023, entitled "STRAW ADAPTER WITH SELF-SEALING VALVE FOR WATER BOTTLES," currently pending, the entire disclosure of which is hereby incorporated herein by reference.

FIELD OF THE INVENTION

This disclosure relates generally to a valve that may be used in a bottle. The valve may be configured to couple a straw to a lid of the bottle. Additionally, the valve may be self-sealing such that the valve reduces the likelihood of unintended spills. The valve may be particularly beneficial when used in a children's water bottle.

BACKGROUND OF THE INVENTION

Like adults, toddlers and children consume fluids throughout the day to stay hydrated and healthy. Unfortunately, children and toddlers are prone to tipping over and spilling their beverages. These spills lead to waste, puddles that must be cleaned up, and potential fabric stains.

Prior solutions to decrease the risk of spills include a self-sealing valve. In a children's water bottle, the self-sealing valve is traditionally designed to be coupled to a connecting piece. The connecting piece is then frictionally engaged with the straw and the lid to form the top portion of the water bottle. The interfaces of the connecting piece with the lid and the straw may include threads or a rubber grommet. However, each interface inevitably allows some air to enter the fluid stream when a user is drinking from the mouthpiece on the lid of the water bottle. To compensate for the air infiltration, the user must apply additional suction to draw the fluid to the top of the straw. This can be particularly challenging for children.

When washing a children's water bottle constructed as described above, the self-sealing valve, connecting piece, and grommets are additional components that must be disassembled, washed, and reassembled. Additionally, the threaded interfaces present small crevices, which can be difficult to clean. The effort required to clean small crevices and to disassemble and reassemble an excess of components can lead parents to neglect thorough washing. This can also lead to mold and bacteria growth, which can be particularly harmful to children. Thus, there is a need for an improved self-sealing valve to address the previously described flaws.

SUMMARY OF THE INVENTION

A straw adapter is provided for coupling a straw with a lid of a bottle. The straw adapter includes an upper tubular portion for coupling the straw adapter with the lid and a lower tubular portion for coupling the straw adapter with the straw. For example, the upper tubular portion may be received in the lid, and the lower tubular portion may include a cavity for receiving the straw. In addition, the upper tubular portion may include outer retaining rings for retaining the straw adapter in the lid, and the lower tubular portion may include inner retaining rings for retaining the straw in the straw adapter.

The straw adapter may further include a valve that opens and closes in response to changes in pressure. In a closed configuration, the valve prevents fluid from flowing through the straw adapter. However, when a user drinks from the bottle, the valve may transition to an open configuration to allow fluid to flow through the valve. Then, when the user is finished drinking, the valve may transition to the closed configuration again. Thus, the valve may reduce the likelihood of a user unintentionally spilling the bottle.

These aspects are merely illustrative of the innumerable aspects associated with the present invention and should not be deemed as limiting in any manner. These and other aspects, features, and advantages of the present invention will become apparent from the following detailed description when taken in conjunction with the referenced drawings.

Figure 1:
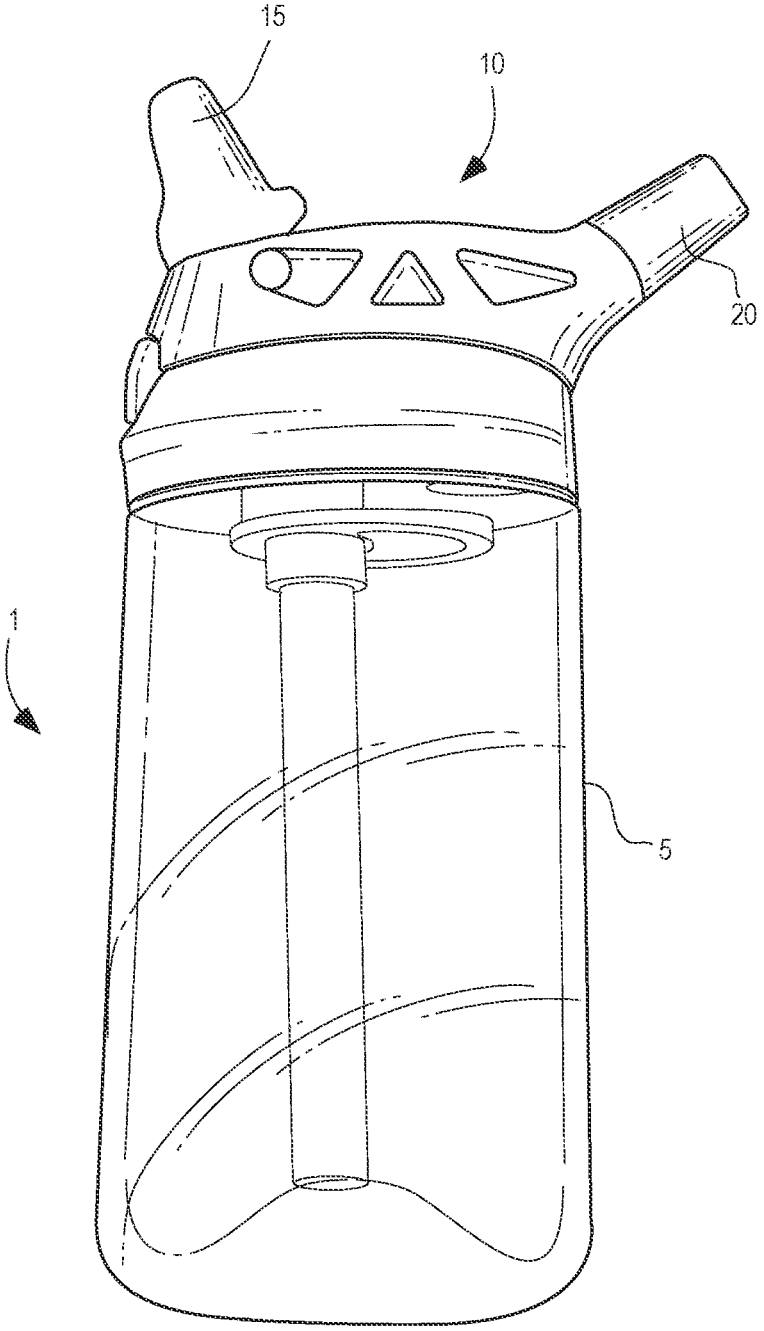
FIG. 1 illustrates a front elevation view of a bottle according to an example embodiment.

Before explaining the disclosed embodiment of the present invention in detail, it is to be understood that the invention is not limited in its application to the details of the particular arrangement shown, since the invention is capable of other embodiments. Example embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE INVENTION

While this invention is susceptible of embodiments in many different forms, there are shown in the drawings and will be described in detail herein specific embodiments with the understanding that the present disclosure is an exemplification of the principles of the invention. It is not intended to limit the invention to the specific illustrated embodiments. The features of the invention disclosed herein in the description, drawings, and claims can be significant, both individually and in any desired combinations, for the operation of the invention in its various embodiments. Features from one embodiment can be used in other embodiments of the invention.

FIG. 1 illustrates a bottle 1 configured to hold liquids. The bottle 1 includes a jar 5 and a lid 10. The lid 10 may include a spout 15 which a user can drink from. The lid 10 may also include a handle 20 that extends outwardly and away from the lid 10. The handle 20 can allow the user to carry the bottle 1 easily and securely.

Figure 2:
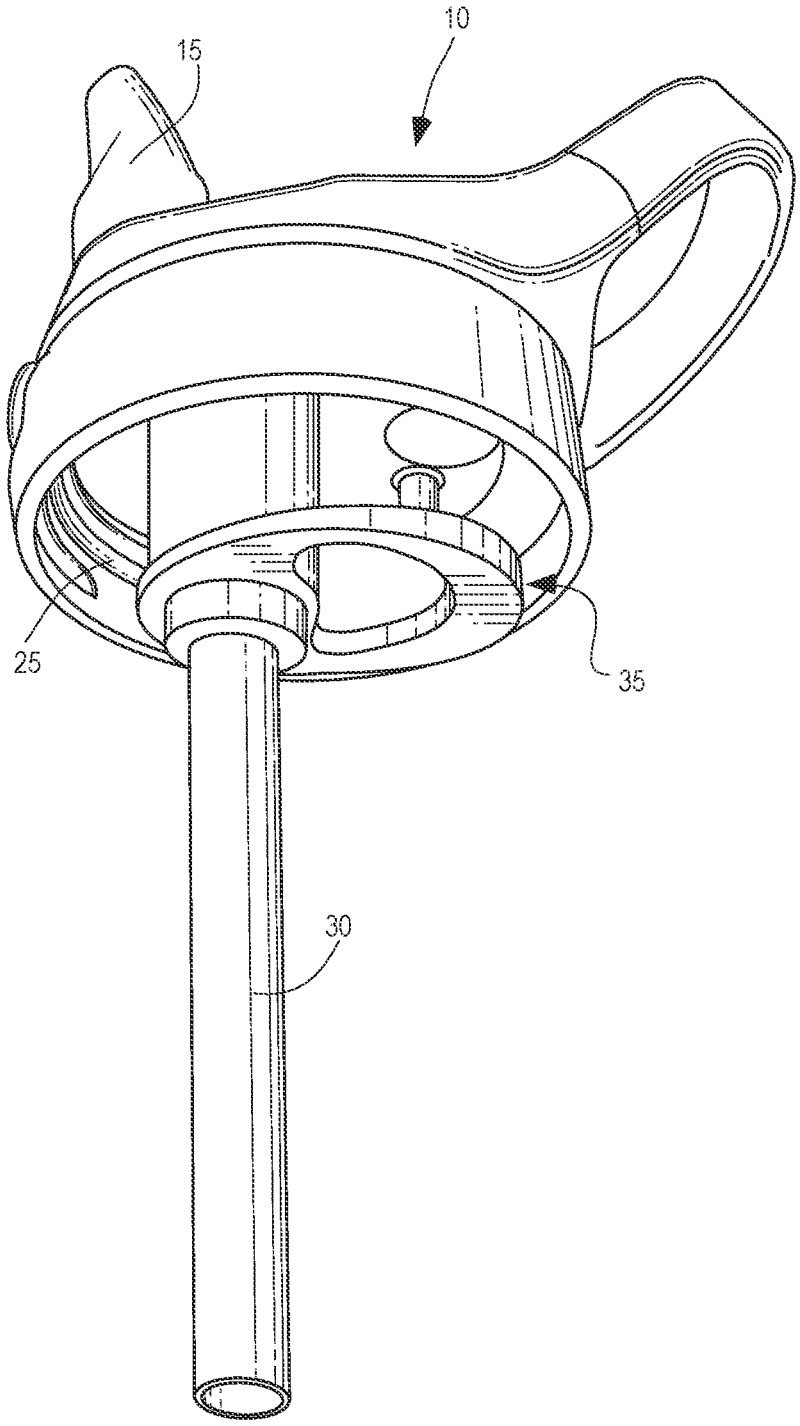
FIG. 2 illustrates the bottle of FIG. 1 with a jar thereof removed.

The bottle 1 is shown in greater detail without the jar 5 in FIG. 2. As illustrated, the lid 10 may further include threads 25 for selectively coupling the lid 10 to the jar 5. However, in alternative embodiments, the method of coupling may vary. For example, in some alternative embodiments, the lid 10 and the jar 5 may be coupled together using a frictional fit, a snap fit, or other forms of coupling as will be appreciated by one of ordinary skill in the art.

The bottle 1 may further include a straw 30 and a straw adapter 35. The straw adapter 35 preferably acts as a means for selectively attaching the straw 30 to the lid 10. In addition, the straw adapter 35 may be a unitary component that is integrally formed. In the illustrated embodiment, the bottle 1 is configured such that when a user drinks from the spout 15, fluid is drawn out of the jar 5 and into the spout 15 by the straw 30 and the straw adapter 35.

Figure 3:
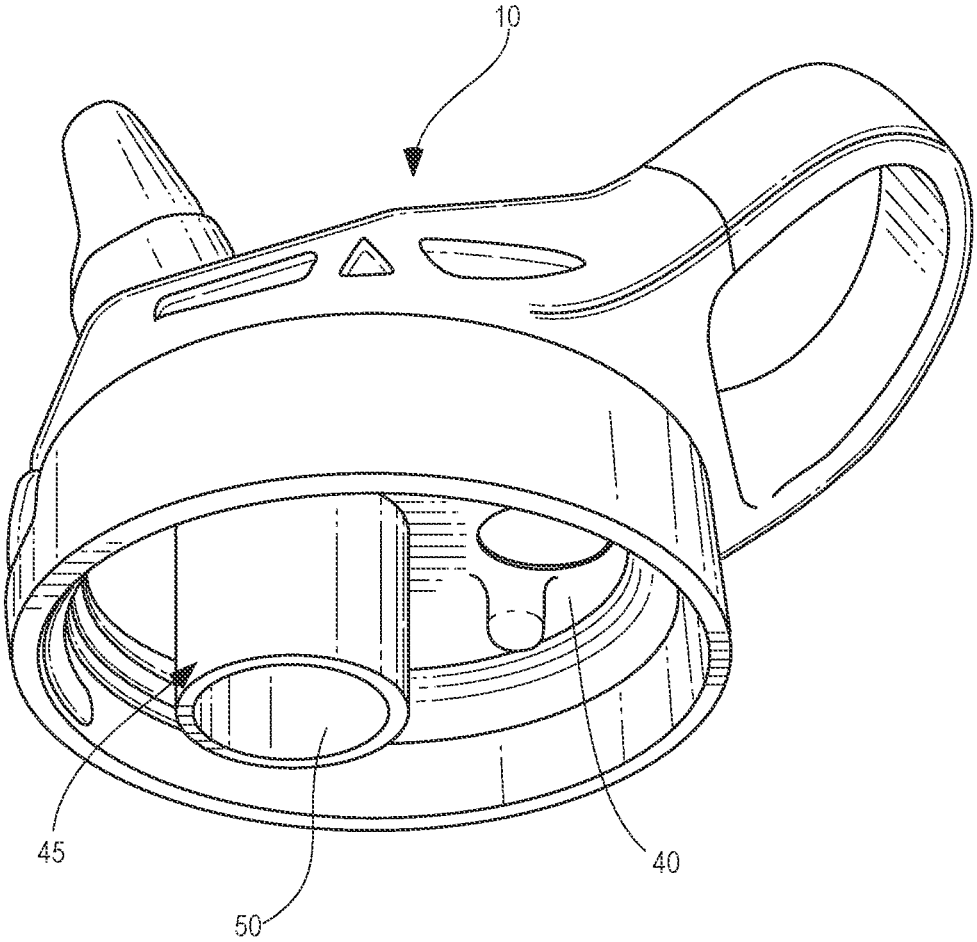
FIG. 3 illustrates a perspective view of a lid of the bottle of FIGS. 1 and 2.

As provided in FIG. 3, the lid 10 includes an underside 40. An adapter receiver member 45 may extend downwardly and away from the underside 40 of the lid 10. In particular, the adapter receiver member 45 may be integrally formed from the underside 40 of the lid 10. Further, the adapter receiver member 45 may include a mating cavity 50 in which the straw adapter 35 may be frictionally retained (see FIG. 2).

Figure 4:
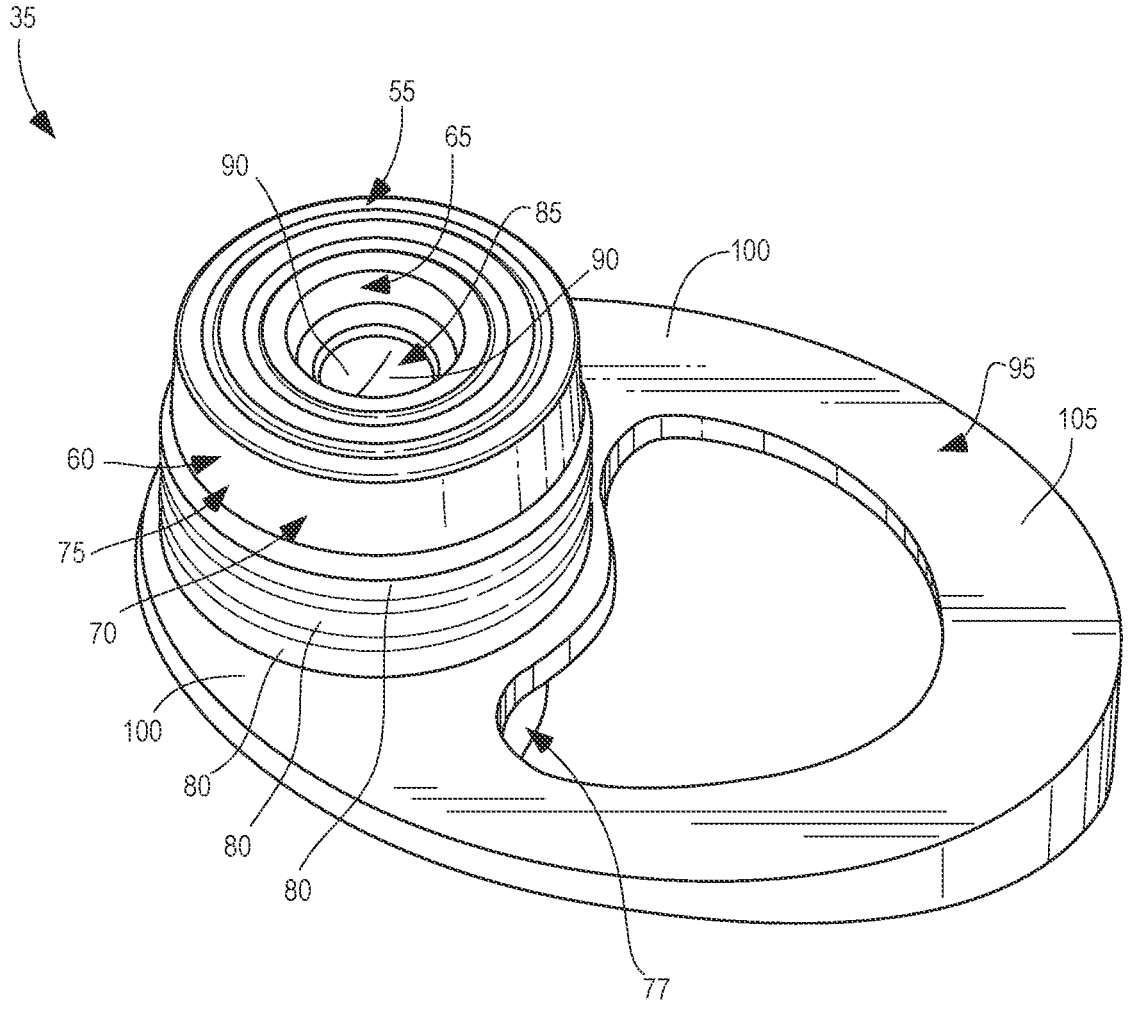
FIG. 4 illustrates a top perspective view of a straw adapter of the bottle of FIGS. 1 and 2.

Turning to FIG. 4, a top side 55 of the straw adapter 35 is illustrated. As illustrated, the straw adapter 35 includes a tubular body 60 with an inner circumference 65 and an outer circumference 70. The tubular body 60 further includes an upper tubular portion 75 positioned and located proximate to the top side 55 and a lower tubular portion 77 positioned and located opposite from and concentric with the upper tubular portion 75.

In the upper tubular portion 75, the outer circumference 70 may be approximately the same size as or slightly smaller than the mating cavity 50. Thus, when the bottle 1 is assembled, the upper tubular portion 75 of the straw adapter 35 may be frictionally retained within the mating cavity 50 of the lid 10 (see FIG. 2). To assist with this frictional engagement, the outer circumference 70 of the upper tubular portion 75 may be circumscribed by a series of outer retaining rings 80. However, in other embodiments, the upper tubular portion 75 of the straw adapter 35 may be alternatively retained using a threaded coupling, a snap fit, or other means of coupling as will be appreciated by one of ordinary skill in the art.

The straw adapter 35 may additionally include a valve 85 that is substantially circular as defined by the inner circumference 65. The valve 85 may be made up of four self-sealing flaps 90 (only two shown in FIG. 4). In response to changes in pressure (such as a user sipping from the spout 15), the self-sealing flaps 90 may flex outwardly. When the self-sealing flaps 90 flex outwardly such that they are oriented substantially vertically (in an open configuration), fluid may pass through the straw adapter 35. When the self-sealing flaps 90 are oriented substantially horizontally (in a closed or sealed configuration) as illustrated in FIG. 4, the self-sealing flaps 90 may impede fluid from flowing through the straw adapter 35. As such, the self-sealing flaps 90 of the valve 85 may reduce the likelihood of a user unintentionally spilling the bottle 1.

In addition, the straw adapter 35 may include an outer end stop ring 95 that extends outwardly from the tubular body 60, preferably between the upper tubular portion 75 and the lower tubular portion 77. The outer end stop ring 95 may include side wing members 100 which are positioned and located on opposing sides of the tubular body 60. The side wing members 100 may be sized and configured such that the straw adapter 35 is wider than the mating cavity 50 proximate to the side wing members 100. As such, the side wing members 100 may prevent the straw adapter 35 from being entirely disposed within the mating cavity 50.

The outer end stop ring 95 may also include a loop member 105. When removing the straw adapter 35 from the lid 10, the user may securely grip the straw adapter 35 via the loop member 105 and pull the straw adapter 35 away from the lid 10. Thus, the loop member 105 may facilitate the removal of the straw adapter 35 from the mating cavity 50.

Figure 5:
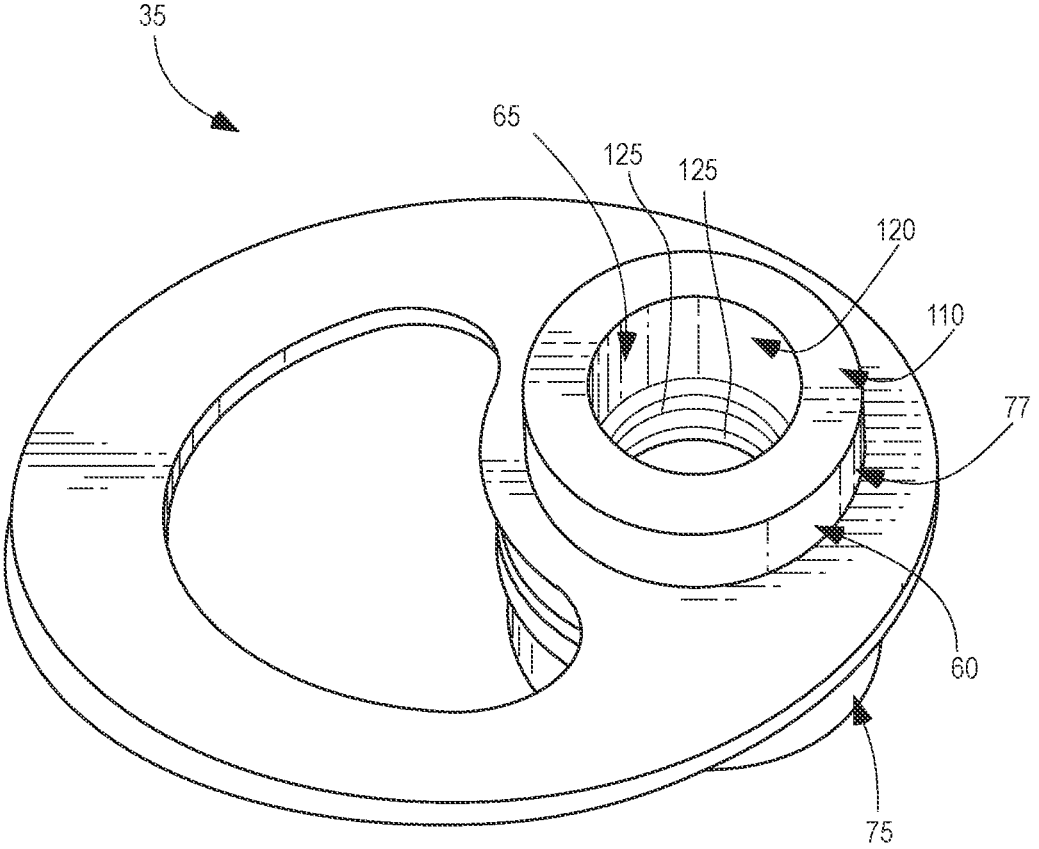
FIG. 5 illustrates a bottom perspective view of the straw adapter of FIG. 4.

In FIG. 5, an underside 110 of the straw adapter 35 is illustrated. At the underside 110, the tubular body 60 may include a straw cavity 120 which is surrounded by the inner circumference 65. When the bottle 1 is assembled, an end (not shown) of the straw 30 is inserted within the straw cavity. As such, the straw 30 may be frictionally retained within the lower tubular portion 77 and part of the upper tubular portion 75. Further, in a preferred embodiment, there may be inner retaining rings 125 circumscribing the straw cavity 120. When the straw 30 is retained within the straw adapter 35 (as illustrated in FIG. 2), the inner retaining rings 125 may increase the frictional engagement of the straw 30 and the straw adapter 35. In other embodiments, the straw 30 may be alternatively retained within the straw adapter 35 using a threaded coupling, a snap fit, or other means of coupling as will be appreciated by one of ordinary skill in the art.

Figure 6:
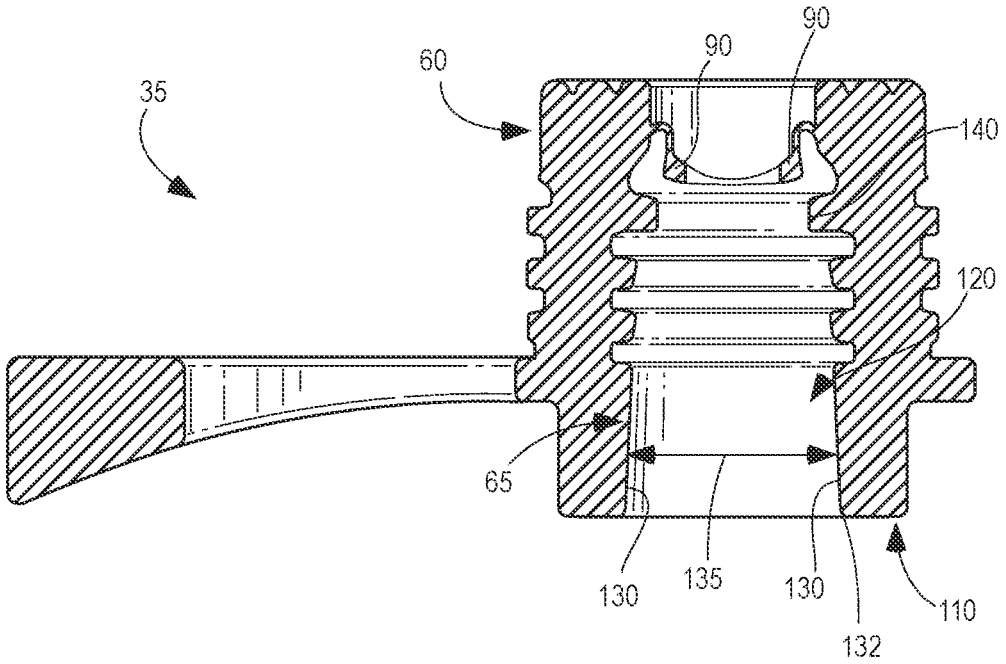
FIG. 6 illustrates a cross-sectional view of the straw adapter of FIGS. 4 and 5.

In FIG. 6, the self-sealing flaps 90 of the straw adapter 35 are in an open configuration. As further illustrated, the straw cavity 120 may include a tapered portion 130 where a diameter 135 of the inner circumference 65 decreases from the underside 110 toward the top side 55. The tapered portion 130 may be positioned and located adjacent to an entrance 132 of the straw cavity 120. Thus, the tapered portion 130 may allow the user to more easily insert the straw 30 into the straw adapter 35 initially. As the straw 30 is further inserted, the tapered portion 130 may assist the user in aligning the straw 30 within the straw adapter 35.

As further illustrated in FIG. 6, an inner end stop ring 140 may protrude radially inwardly from the inner circumference 65. The inner end stop ring 140 may have a smaller diameter than the straw 30. Thus, when the straw 30 is inserted into the straw cavity 120, the inner end stop ring 140 may prevent the straw 30 from abutting the self-sealing flaps 90.

Figure 7:
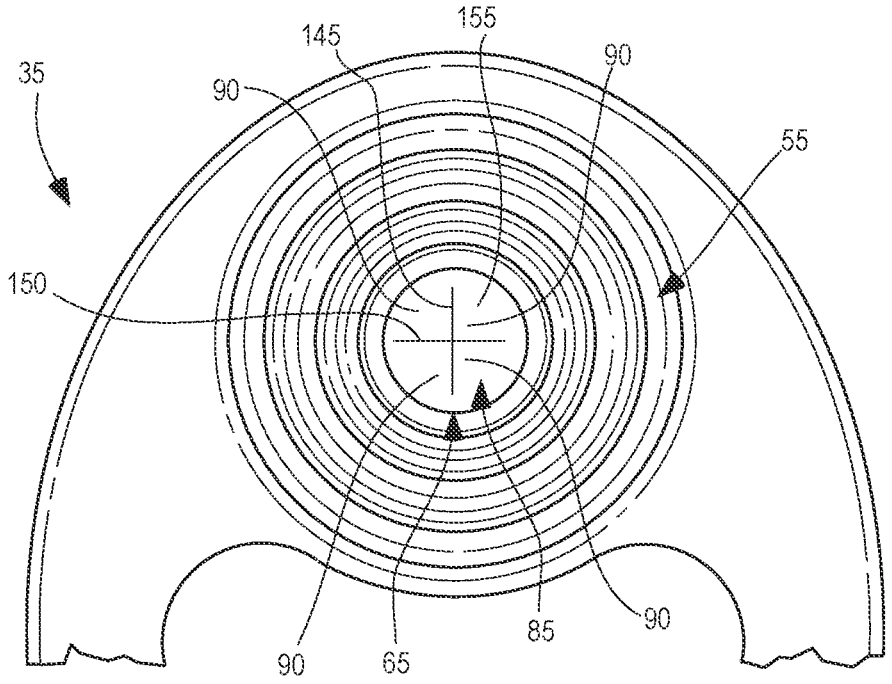
FIG. 7 illustrates a partial top view of the straw adapter of FIGS. 4-6.
Figure 8:
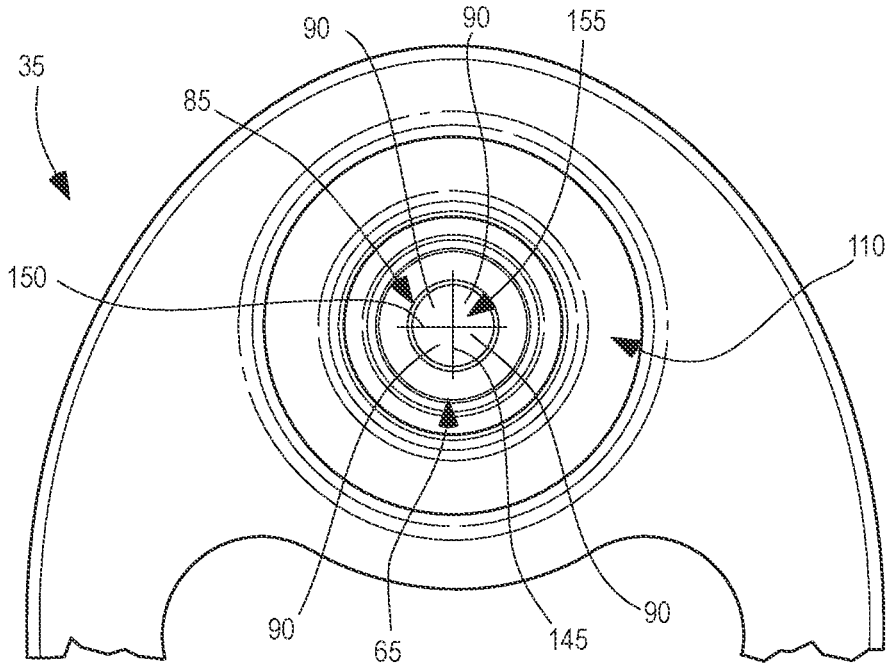
FIG. 8 illustrates a partial bottom view of the straw adapter of FIGS. 4-7.

Turning to FIGS. 7 and 8, the top side 55 and the underside 110, respectively, of the straw adapter 35 are illustrated with the self-sealing flaps 90 in the closed configuration. The four self-sealing flaps 90 of the valve 85 are formed by a first slit 145 and a second slit 150 in a thin membrane 155. The thin membrane 155 abuts and spans the inner circumference 65 and may be integrally formed with the straw adapter 35. The first slit 145 and the second slit 150 are substantially perpendicular to each other in the illustrated embodiment, though other patterns are foreseeable. When viewed from the top side 55 (as in FIG. 7), the thin membrane 155 is concave. When viewed from the underside 110 (as in FIG. 8), the thin membrane 155 is convex.

Figure 9:
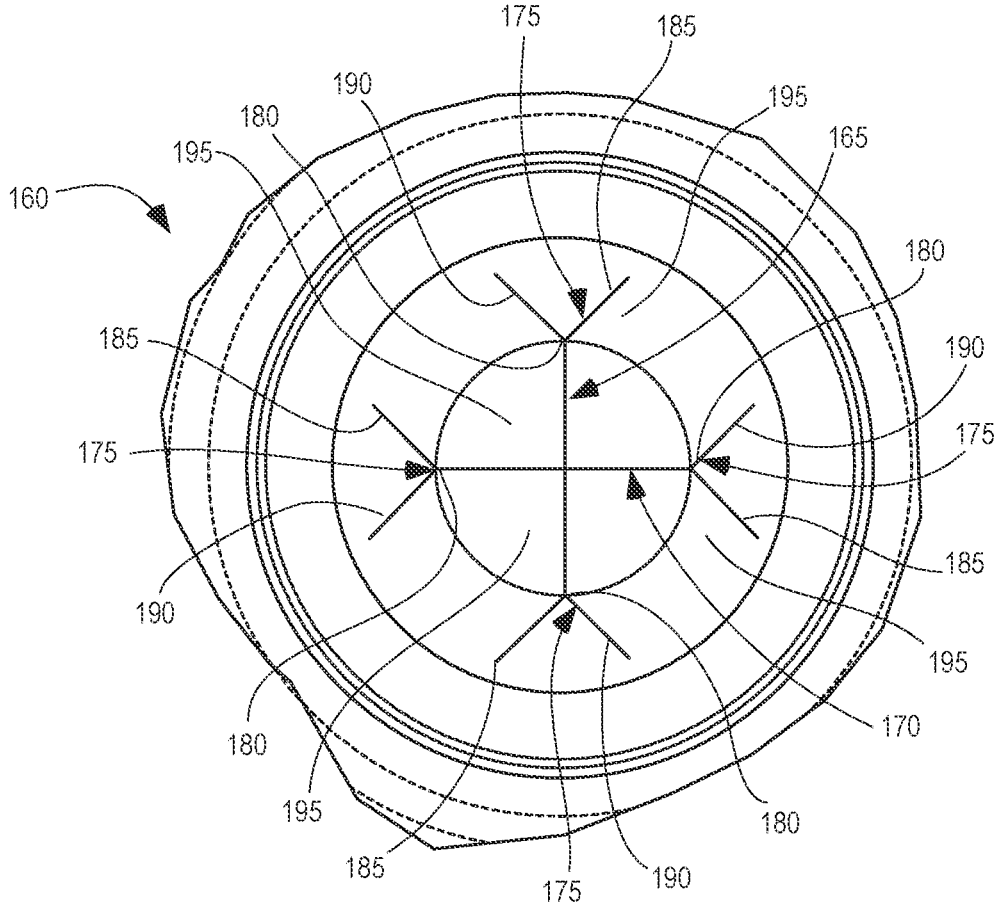
FIG. 9 illustrates a partial top view of an alternative straw adapter.

In FIG. 9, an alternative straw adapter 160 is provided. The straw adapter 160 is substantially similar to the straw adapter 35 aforementioned. However, unlike the slits 145, 150, a first slit 165 and a second slit 170 of the straw adapter 160 include crab cuts 175 at each distal end 180. More particularly, the crab cuts 175 include a first ancillary slit 185 and a second ancillary slit 190 that meet at the distal ends 180 of the slits 165, 170. The ancillary slits 185, 190 may be at an approximately 90° angle to one another. As such, an alternative arrangement of self-sealing flaps 195 is formed. Such arrangement of self-sealing flaps 195 may flex outwardly under reduced pressure gradients. As such, the straw adapter 160 may require less suction force from the user and, therefore, may be easier to drink from.

In additional alternative embodiments of a straw adapter, the number of self-sealing flaps may vary. In some of these embodiments, the number of slits may also vary (i.e., six self-sealing flaps may be formed by three slits). Additionally, in other embodiments, the configuration of the slits and self-sealing flaps may vary (i.e., four self-sealing flaps may be formed by four slits in some embodiments). Nevertheless, in all embodiments, the slits should be cut precisely to help ensure a hermetic seal and reduce the likelihood of unintended spills.

Specific embodiments of a straw adapter for a bottle according to the present invention have been described for the purpose of illustrating the manner in which the invention can be made and used. It should be understood that the implementation of other variations and modifications of this invention and its different aspects will be apparent to one skilled in the art, and that this invention is not limited by the specific embodiments described. Features described in one embodiment can be implemented in other embodiments. The subject disclosure is understood to encompass the present invention and any and all modifications, variations, or equivalents that fall within the spirit and scope of the basic underlying principles disclosed and claimed herein.

What is claimed is:

1. A straw adapter for use in a bottle with a straw and a lid, the straw adapter comprising:

a body portion having a first side and a second side;

a protrusion extending outwardly from the first side of the body portion, the protrusion configured to be received in the lid; and a straw-receiving cavity extending into the second side of the body portion, the straw-receiving cavity configured to receive the straw; and a plurality of inner retaining rings circumscribing an inner circumference of the straw-receiving cavity, the plurality of inner retaining rings configured to retain the straw in the straw-receiving cavity via a friction fit.

2. The straw adapter of claim 1, further including a valve integrally formed with the protrusion.

3. The straw adapter of claim 1, further including an outer end-stop ring abutting an outer circumference of the protrusion such that the second side of the straw adapter is positioned and located outside of the lid.

4. The straw adapter of claim 1, further including a loop member for decoupling the straw adapter from the lid.

5. A straw adapter for use in a bottle with a straw and a lid, the straw adapter comprising:

a body portion having a first side and a second side;

a protrusion extending outwardly from the first side of the body portion, the protrusion configured to be received in the lid;

a straw-receiving cavity extending into the second side of the body portion, the straw-receiving cavity configured to receive the straw; and a plurality of outer retaining rings circumscribing an outer circumference of the protrusion, the plurality of outer retaining rings configured to retain the straw adapter in the lid via a friction fit.

6. A bottle comprising:

a jar for holding a beverage;

a lid selectively couplable to the jar;

a spout positioned and located on the lid, the spout configured for drinking therefrom;

a straw adapter configured to couple with the lid; and a straw configured to be received in the straw adapter, wherein the straw adapter includes inner retaining rings configured to couple the straw with the straw adapter.

7. The bottle of claim 6, wherein the straw adapter is integrally formed as a unitary component.

8. The bottle of claim 6, wherein the straw adapter is retained in the lid via a friction fit.

9. The bottle of claim 6, wherein the straw adapter includes a valve integrally formed therewith, and wherein the valve is configured to regulate fluid flow through the straw adapter.

10. The bottle of claim 9, wherein the straw adapter further includes an end-stop ring configured to prevent the straw from abutting the valve when the straw is retained in the straw adapter.

11. The bottle of claim 6, wherein the straw adapter is directly coupled to the lid and the straw.

* * * * *